United States Patent [19]

Giorgi

[11] Patent Number: 4,717,646

[45] Date of Patent: Jan. 5, 1988

[54] COMPOSITION AND METHOD FOR RESTORING OR COLOR CORRECTING FADED COLOR PHOTOGRAPHS AND SNAPSHOTS

[76] Inventor: Lewis A. Giorgi, 17 Normandy Rd., Yonkers, N.Y. 10701

[21] Appl. No.: 904,560

[22] Filed: Sep. 5, 1986

Related U.S. Application Data

[63] Continuation-in-part of Ser. No. 673,950, Nov. 21, 1984, abandoned.

[51] Int. Cl.[4] ..... G03C 11/04; G03D 15/00; B65D 69/00; B65D 71/00

[52] U.S. Cl. ..... 430/359; 430/357; 430/370; 430/373; 430/432; 430/463; 430/644; 8/517; 8/607; 206/568; 206/578; 354/348; 427/258; 427/260; 428/195

[58] Field of Search ..... 430/359, 357, 370, 373, 430/432, 463, 644; 8/517, 607; 428/195; 427/258, 260; 354/348; 206/568, 518

[56] References Cited

U.S. PATENT DOCUMENTS

| | | | |
|---|---|---|---|
| 134,693 | 1/1873 | Mettais | 428/195 |
| 949,708 | 2/1910 | Jenkins | 206/578 |
| 1,077,835 | 11/1913 | Kelly | 206/578 |
| 1,139,682 | 5/1915 | Hochstetter | 430/644 |
| 1,676,739 | 7/1928 | Marckworth | 430/644 |
| 2,327,854 | 8/1943 | Berggren | 354/348 |
| 3,445,176 | 5/1969 | Jamieson | 8/552 |
| 3,849,153 | 11/1974 | Giorgi | 430/359 |
| 3,931,431 | 1/1976 | Giorgi | 428/195 |
| 4,271,965 | 6/1981 | Brambley | 206/578 |
| 4,294,349 | 10/1981 | Ibsen et al. | 206/568 |

OTHER PUBLICATIONS

"Print Finishing Techniques", Basic Developing, Printing, Enlarging in Color, Eastman Kodak, 1977, pp. 82–85.

*Primary Examiner*—Richard L. Schilling
*Attorney, Agent, or Firm*—Jacobs & Jacobs

[57] ABSTRACT

A method and system are provided for enabling amateurs and non-professionals to restore faded or discolored color photographs and snapshots to their original condition by treating the faded or discolored color photographs and snapshots to clean areas with a remover of anhydrous acetone-free diacetone and coating or coloring the cleaned areas with a color corrective restorer comprising a powdered dye embedded or dispersed in anhydrous diacetone preferably in the relative proportions of 40 grains dye: 30 ml anhydrous diacetone or by using wax cube compositions of alcoholic paraffin or other suitable wax with acetone-free diacetone in the relative proportions of 100 grams wax in alcohol: 1–3 grams powdered dye therein in the optional presence of liquid glycerin and/or lecithin. Procedure and equipment as described for carrying out the invention which is characterized by the slower evaporation rate of diacetone as compared to denatured alcohol to provide adequate time to carry out the process steps.

3 Claims, No Drawings

COMPOSITION AND METHOD FOR RESTORING OR COLOR CORRECTING FADED COLOR PHOTOGRAPHS AND SNAPSHOTS

This application is a continuation-in-part of my application Ser. No. 673,950 filed Nov. 21,1984 and now abandoned.

NATURE OF THE INVENTION

This invention relates to the restoration of faded, discolored and stained color photographs to make them resemble their original condition and to the treatment of color snapshots which are overexposed, underexposed or imperfectly developed to improve their appearance by means of a novel system and procedure, and optionally to coat the restored and treated photographs and snapshots with a transparent protective film to preserve their restored appearance.

BACKGROUND OF THE INVENTION

Various compositions and procedures are known for treating or modifying photographic paper and photographs using dyeing, coating or smoothing materials for obtaining desired effects such as with gums, shellacs, lacquers, alcoholic solvents, acids, oil pigments and waxes.

It is also known to apply polyhydric alcohols or alcohol ethers or alkyd resins and a dye solution to photographs and to drive the dye into the gelatin layer of photographs or to add an accelerator solution of distilled water and acetic acid whenever it is desired to obtain faster penetration of colloid surfaces of photographs. The prior art does not however make use of an anhydrous system or composition capable of obtaining the results of my invention and in particular does not use acetone-free diacetone which has a slower than alcohol evaporation time unique for my restoration of photographs to give time for rendition of detail.

Except for my U.S. Pat. Nos. 3,931,431 and 3,849,153 and the water-dye contents of Eastman Kodak Company publication of 1977 relating to basic developing, printing and enlarging in color, the prior art has no recognition or teaching directly applicable to my present invention and in fact is very varied and generally irrelevant.

To bring out further the distinctions of my invention over the prior art, U.S. Pat. No. 134,693 is concerned with black and white paper to which is applied color pigment, wax and oils but at the date of that patent in 1873, color gelatin emulsions on paper were unknown and hence the patent is not applicable to gelatin emulsions on paper or film of the Kodak type.

U.S. Pat. No. 949,708 involves an agent to absorb water from a color paper colloid gelatin prior to adding separate color dyes for restoration purposes in relation to packages, tubes and chemical storage problems.

U.S. Pat. No. 1,077,835 deals with gum or shellac for packaging and the uniting of dish-shaped flanged sections into a single unit and is unrelated to my present invention.

U.S. Pat. No. 1,139,682 describes the restoration of scratched motion picture films of ancient vintage using a fatty base and alcohol and is readily distinguishable from my invention.

U.S. Pat. No. 1,676,739 describes oils, crayons and wax pencils and must necessarily use a black and white paper, not a color emulsion as a substrate.

U.S. Pat. No. 2,327,854 describes crayons containing waxes and dyes together with oils for use on black and white photographic paper, but the oils cannot be used on color paper or directly over emulsions.

U.S. Pat. No. 3,445,176 describes a procedure that can be carried out only with steam and water and is extremely difficult to control and hence unsuitable for use by an amateur photographer to use acetic acid as a penetrant. This patent also notes that the choice of solvent is important.

U.S. Pat. No. 4,271,965 relates to chemical containers for dispensing film developing and processing mechanism and contains no teaching or suggestion of my invention, nor could the system of the patent be carried out by amateurs as it is complex and requires special controls.

U.S. Pat. No. 4,294,349 restores damaged porcelain dental prostheses and similar articles, using pigment-resin mixtures and has no relationship to the restoration of photographs and snapshots involved by my invention.

THE PRESENT INVENTION

This invention more particularly relates to a method and composition for restoring or color-correcting faded, discolored color photographs or snapshots to make them resemble their original or natural condition as nearly as possible expecially with respect to skin and clothing tones, it being well known that such color photographs or snapshots fade or deteriorate due to exposure to sunlight, air or pollutants and consequently the color photographs become unattractive, unnatural or pale in appearance. This is a widely encountered occurrence and the owners or possessors of such faded or discolored color photographs are usually desirous of restoring them, particularly when they are photographs of family forebears or relatives or memorable scenes. While it is possible to obtain some degree of restoration by professional photographers, studios or specialized photographic laboratories depending on the pre-restored condition of the photograph or snapshot, the present invention makes it possible for amateurs or non-professionals to simply and easily carry out procedure and means for restoring such photographs and snapshots rapidly and inexpensively.

The restoration according to the present invention is intended to be carried out as a do-it-yourself project by amateurs wherein a faded color photograph is restored or color-corrected or adjusted in appearance by first applying to the faded or discolored area(s) to be restored or color-corrected a small amount of solvent acetone-free diacetone (hereinafter sometimes called remover) to clean the area and render it moisture proof by hand-stroking the photograph or snapshot with a cotton swab or "Q-Tip" or other absorbent or drying cloth or material. I have found that this preliminary use of acetone-free diacetone uniquely provides a desirable and moderate cleaning and solvent power of extremely low acidity without the strong or high solvent power of acetone and without destructive spotty effect on the faded color photograph.

Diacetone is a ketone which meets all the requirements of the present invention and is the only substance which I have found to be suitable. While it has been previously known to use polyhydric alcohols or alcohol ethers or alkyd resins in connection with the application of colors to uncolored areas or for the purpose of creating novel or original scenic representations, my system instead is used in color solution form with a moisture-proofed dye with or without the addition of a penetrant such as acetic acid, water or steam. It is important to know that the colloid gelatin acts as a blotter that can easily incur unremovable absorbed color spots on the photograph. Thus it does not require a professional person to perform such a correction. In contrast, it is novel, unique and easy to carry out the restoration method or color-correction of faded color photographs or snapshots in accordance with my present procedure.

According to my invention acetone-free diacetone is thus first applied to the faded area to clean the same and render it moisture proof followed by coating the cleaned area with a wax-dye composition of Example I containing dye incorporated in paraffin or stearic acid wax or other suitable wax optionally containing a surfactant; or alternatively by means of a wax cube composition of Example I and then applying the same either to affected portions or to small areas of old or faded color photographs or snapshots and blending to the desired appearance. The thus restored color photograph or snapshot has any excess materials removed and then the restored photograph or snapshot is protected so that the resulting appearance is rendered permanent as by coating the treated area(s). A thin protective material such as a clear vinyl coating or a good grade of clear lacquer spray is suitable for that purpose or optionally can remain as is or can be lightly buffed.

I have found it to be particularly advantageous to provide a kit with a set of small closable containers of suitable plastic material in each of which is disposed a wax cube which has a powdered dye of desired color embedded or incorporated therein of Example I formulations and/or also known marking devices which may be of conventional nature or dye solutions of Example II. The wax-dye cubes and marking devices may be in a variety of colors which also may be used in combination, if desired, for blending or mixing purposes. In addition, each container is provided with a wax-cube composition which is a formulation having for example a 1" to 1½" or other size square cube of wax containing a dye of desired color with about 10 ml of acetone-free diacetone. This results in a formulation which comprises the following components in the following relative proportions:

EXAMPLE I

Wax Cube Compositions

| | |
|---|---|
| Formula A | |
| Alcoholic Paraffin Wax or Alcoholic Stearic Acid Wax | 100 grams (total) |
| Liquid Glycerin | q.s. |
| Formula B | |
| Powdered Dye | 1–3 grams |
| Acetone-free Diacetone | 10 ml |
| Lecithin | q.s. |

It is understood that formulations A and B are admixed. This composition whenmixed allows flexibility to melt and add more or less density of color according to the hues, values and the manufacture and accuracy due to viscosity in the form of cubes.

The amount of powdered dye in the above formulation is to be considered as only representative or typical and not as a limitation because it will be understood and appreciated that the amount of alcoholic powdered wax, dye or liquid glycerin used in a particular instance not only depends on the original color of the color photograph to be restored but also depends on the concentration and intensity of the dye itself. For example, the formulation may be prepared by mixing the powdered dye with the diacetone and applied over the color gelatin paper of the photograph to be restored and under such conditions I have found that the dye is not absorbed by the gelatin in the absence of moisture and this is important because the dye would thereby become "fixed" prematurely by creating a stain in the gelatin.

It is understood that the foregoing sequence of process steps may be repeated one or more times when such is found to be necessary or desirable to give the required degree of restoration or color-correction. Depending upon the surface to be restored and the extent of fading thereof, the procedure above described may be varied or modified by using a greater or lesser amount of dye or by using dyes of greater color intensity. Thus the invention has a wide versatility for application to color photographs which are faded or require color-correction to different degrees especially where the faded image areas are to restore skin and clothing tones. Usually, a final clear protective lacquer coating is optionally applied or instead buffed with cotton and applied prior to the use of the lacquer coating to remove any "bloom" which might form.

The invention is also applicable to old faded color photographic images or to relatively recent color photographic images which have been over-exposed or under-exposed during the photographing of the subject or resulting from poor color printing. While I prefer to carry out the invention from paraffin and stearic acid wax-dye cubes or granules with the powdered dye embedded or incorpoated therein (Example I) or with the color dye devices of Example II, I may optionally provide a dye solution wherein the dye or a mixture of dyes is dissolved in the diacetone to make up a composition as described above and with which paraffin or stearic acid wax can be combined as also and analogously described above in connection with the coloring devices. In this way, the use of the invention is somewhat simplified for amateurs or non-professional photographers. While alcoholic stearic acid wax and paraffin have been found best and paraffin being preferred, other fatty acid waxes such as oleic acid wax may be substituted. In referring above to a surfactant wax, it is to be understood that the stearic acid wax or other wax employed in the invention can have admixed therewith any well known compatible surfactant which facilitates application of the wax by reduction of surface tension or increasing the dispersive action. Such surfactant is usually a non-ionic fatty-acid ester of which many are known. Optionally, I may substitute an equivalent amount or volume of ceresin, carnauba or montan wax.

EXAMPLE II

Liquid Color Dye Devices

| | | |
|---|---|---|
| Diacetone (anhydrous) | 30 ml | dye solution |
| Powdered Dye | 40 grains | |

The alternative formulation of this Example is used in a manner comparable to Example I with the exception that the amount of powdered dye used varies according to the density of the dye, i.e., the greater the density the lesser the amount used as will be readily understood. In addition, the amount of water-free dye solution of Example II is selected to give the desired hue or shade to the materials employed for achieving the desired or potential photograph restoration.

It is understood also that in a modified form of the invention the diacetone used in the process may, if desired, be used in conjunction with anhydrous polyhydric alcohols or alcohol ethers or alkyd resins, thereby providing greater versatility.

It is further to be understood that since the present invention is directed to amateur or do-it-yourself photographers, a suitable set of printed instructions is provided with each kit or set of components to enable the effective carrying out of the method to obtain the desired results.

Liquid Dye Formula

Solutions of the powdered dye in anhydrous diacetone are in the relative proportions of 40 grains: 30 ml, thus providing a water-free liquid dyeing formulation. The formula prevents color dye moisture absorption, indeed dye will not penetrate, spot or swell the gelatin (as was remarked in Jamieson U.S. Pat. No. 3,445,176) and is easily removed with diacetone and cotton.

Transparent Liquid Dye Method For Carrying Out Example II

Materials required: bottles or marking devices, color dye, Q-Tips, brushes, tortillions, toothpicks, cotton balls and my remover:

(a) Apply remover solution over areas of restoration with one drop from a bottle or marking device remover.

(b) Spread evenly and circulate with Q-Tip or cotton balls until two thirds dried or more.

(c) Drying time, according to humidity or dryness, varies from 6 seconds to 20 seconds. Apply color dye with selected color dye or drop one drop onto a Q-Tip from the drop bottle.

(d) Circulate the color dye with Q-Tip, brush, cotton ball, gently and evenly until dry.

(e) For deeper shades or change of hues, tones or values add colors on top of each other. Note: Each color must be well dried before applying another.

(f) To highlight areas, use remover with toothpicks very lightly. This is similar to removal of some color dye, thus reflecting the original base, or rub to highlight areas with Q-Tips or with color dye remover.

(g) Clean edges with marking device dye remover or drop one drop from the dropper bottle onto Q-Tip.

(h) When dry (in approximately ½ hour), it can remain as is. Thus upon drying the process provides adherence sufficiently to harden the dye well enough so that it will not easily rub off. Or, if desired, a light spray of lacquer can be added. If a bloom reflects, it will disappear under the glass or clear plastic, before lacquer is sprayed. The remover solution will remove all or part of the colors ready to begin again.

Transparent Wax Base Formula and Preparation For Carrying Out Example I

An anhydrous method of restoring color photographs or snapshots for use by amateurs and having faded or discolored areas to be restored or color corrected which comprises preliminary (first) applying to the faded or discolored areas to be restored only enough acetone-free water- anhydrous diacetone to prepare such areas for the reception of a restorative amount of wax based dyes enclosed in a tray or plastic compact of small wells of required color and thereafter applying the selected color dye to the reception areas, the dye being in powdered form in paraffin or stearic acid wax and acetone-free diacetone with liquid glycerin and lecithin in the relative proportions of 100 grams of wax to 1–3 grams of powdered dye and 10 ml of acetone-free diacetone.

Transparent Wax Dye Steps

To prepare the photograph for restoration, the diacetone remover solution is required. Needed materials: Q-Tips, brushes, toothpicks, cotton balls, remover, tortillions, coloring device or plastic drop bottle.

(a) Apply one drop from bottle of remover on photograph areas of restoration, and simultaneously (b) Add one drop over the preferred color wax dyes, which are encased in a tray with wells or a plastic compact.

(c) Spread remover evenly over photograph with Q-Tip or cotton balls until two thirds dry. Drying time, according to ambient humidity or dryness, varies from 6 seconds to 20 seconds. Transfer selected wax base color dyes of your choice by using a Q-Tip or brush.

(d) Circulate the color dye with Q-Tip, brush or cotton ball gently and evenly until dry.

(e) For deeper shades or change of hues, tones or color values, add colors on top of existing colors over one another.

(f) To highlight areas, use toothpicks very lightly. This is similar to removing some color dye thus reflecting the original base of the original photo, or alternatively rub with Q-Tips using remover.

(g) Clean edges with color remover or drop one drop from the dropper bottle onto Q-Tip.

(h) When dry, (in approximately ½ hour), it can remain as is. Upon drying it will harden. Light buffing can be carried out with a clean cotton ball or a light spray of lacquer. If it reflects a bloom, it will not show under the glass or clear plastic when placed in an album or frame.

(i)If not pleased with selected colors, the remover solution can be used to remove all or partial color and the series of steps done over again.

What is claimed is:

1. An anhydrous method of restoring faded or discolored color photographs or snapshots for use by amateurs which comprises cleaning those areas of the photographs or snapshots to be restored or color corrected by a preliminary water-free application of anhydrous acetone-free diacetone to remove any moisture or swelling from steam or water present in the gelatin emulsion of the photographs or snapshots, followed by coating the cleaned areas with a color corrective restoration solution of a powdered dye in anhydrous diacetone in the relative proportions of 40 grains:30 ml, thus providing a water-free liquid dyeing formulation.

2. An anhydrous method of restoring color photographs or snapshots for use by amateurs and having faded or discolored areas to be restored or color corrected, which comprises preliminarily applying to the faded or discolored areas to be restored only enough acetone-free anhydrous diacetone to prepare such areas for the reception of a restorative amount of a wax-based dye of required color and thereafter applying the dye to the receptive areas, the dye being in powdered form of alcohol paraffin or stearic acid wax and acetone-free diacetone with liquid glycerin and lecithin in the relative proportions of 100 grams of wax to 1–3 grams of powdered dye and 10 ml of acetone-free diacetone, and both applying steps being carried out with circular or longitudinal strokes.

3. A kit for use in the color restoration or color correction of a faded color photographic image which comprises as one part a plastic container which is openable and closable and in which is disposed a series of paraffin or stearic acid wax-dye cubes of a variety of sizes, colors and intensities or marking devices of a plurality of colors and, as a separate part, suitable containers of acetone-free diacetone and glycerin.

* * * * *